US009846398B2

(12) United States Patent
Akashi et al.

(10) Patent No.: US 9,846,398 B2
(45) Date of Patent: Dec. 19, 2017

(54) IMAGE FORMING APPARATUS

(71) Applicant: Konica Minolta, Inc., Tokyo (JP)

(72) Inventors: Hironori Akashi, Okazaki (JP); Masahiro Kouzaki, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/433,522

(22) Filed: Feb. 15, 2017

(65) Prior Publication Data

US 2017/0242383 A1 Aug. 24, 2017

(30) Foreign Application Priority Data

Feb. 22, 2016 (JP) ..... 2016-030784

(51) Int. Cl.

*G03G 15/04* (2006.01)
*G03G 15/041* (2006.01)
*G03G 15/00* (2006.01)

(52) U.S. Cl.

CPC ..... *G03G 15/5033* (2013.01); *G03G 15/041* (2013.01); *G03G 15/04018* (2013.01); *G03G 15/04045* (2013.01); *G03G 15/75* (2013.01); *G03G 15/751* (2013.01); *G03G 15/752* (2013.01)

(58) Field of Classification Search

CPC ..... G03G 15/04018; G03G 15/04045; G03G 15/041; G03G 15/5033; G03G 15/75; G03G 15/751; G03G 15/752; G03G 2215/00071; G03G 2215/0426; G03G 2215/0429; G03G 2215/048; G03G 2215/049

See application file for complete search history.

(56) References Cited

U.S. PATENT DOCUMENTS 5,773,175 A * 6/1998 Taniguchi ..... G03G 5/04 430/130
2007/0189788 A1* 8/2007 Hagiwara ..... G03G 15/0275 399/44

FOREIGN PATENT DOCUMENTS

JP 2004029100 A 1/2004
JP 2004289873 A 10/2004
JP 2013118597 A 6/2013

* cited by examiner

*Primary Examiner* — Joseph S Wong
(74) *Attorney, Agent, or Firm* — Lucas & Mercanti, LLP

(57) ABSTRACT

An image forming apparatus which forms an image on a medium on the basis of an input image signal includes: an image carrier configured to carry a developed toner image transferred to the medium on a photoreceptor layer; a contact member arranged so as to be in contact with the surface of the photoreceptor layer; a trace pattern generating unit configured to generate a trace pattern indicating specific information on the image forming apparatus; a composition unit configured to add the trace pattern to the image signal; and an acquiring unit configured to acquire information on the thickness of the photoreceptor layer of the image carrier, wherein the trace pattern is used for arranging a plurality of image areas at respective positions, and the trace pattern generating unit is configured to generate the trace pattern with the image area whose size is reduced in accordance with reduction of the thickness of the photoreceptor layer.

13 Claims, 12 Drawing Sheets

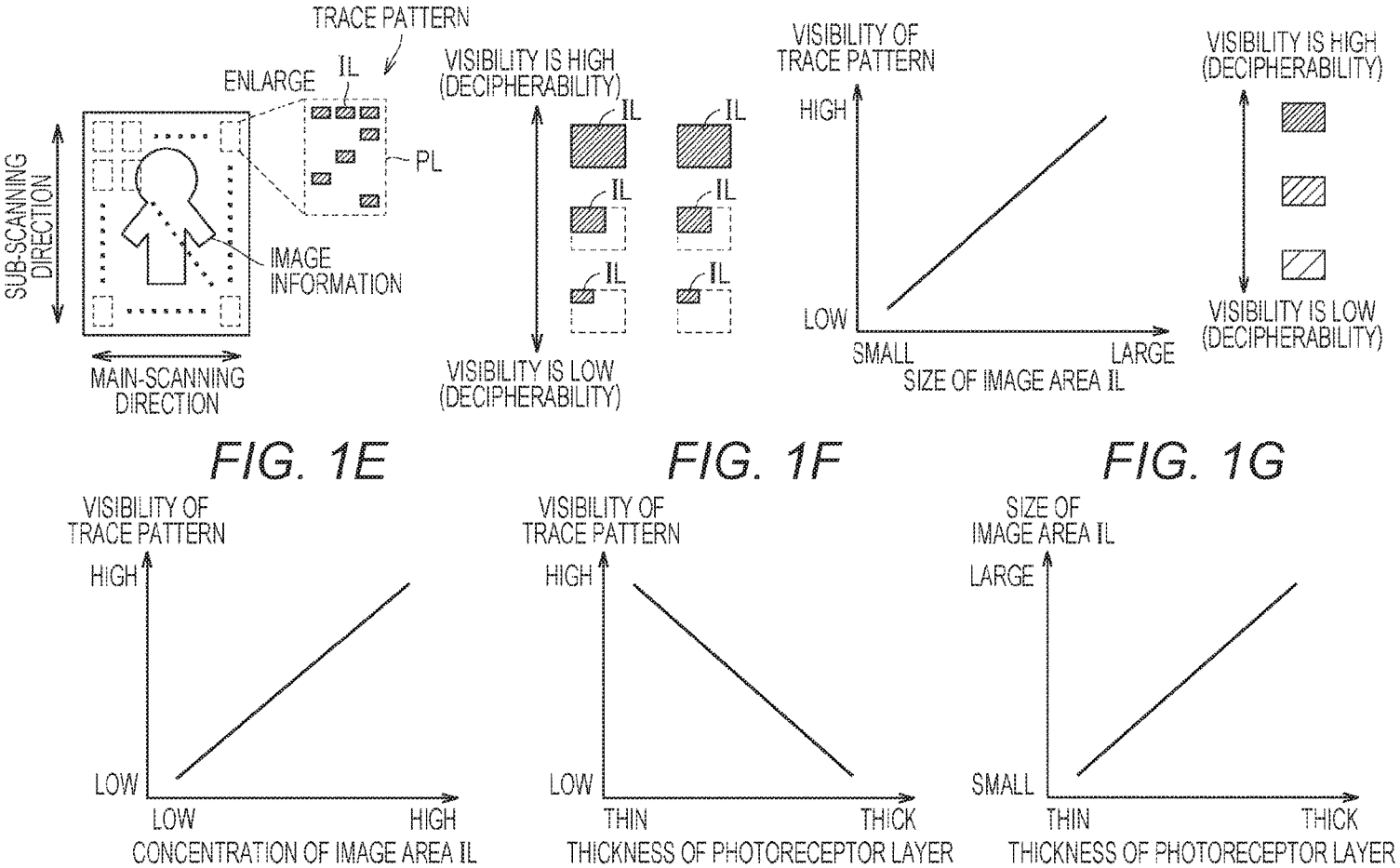
FIG. 1A
TRACE PATTERN
IL
PL
ENLARGE
IMAGE INFORMATION
SUB-SCANNING DIRECTION
MAIN-SCANNING DIRECTION
FIG. 1B
VISIBILITY IS HIGH (DECIPHERABILITY)
VISIBILITY IS LOW (DECIPHERABILITY)
IL
FIG. 1C
VISIBILITY OF TRACE PATTERN
HIGH
LOW
SMALL
LARGE
SIZE OF IMAGE AREA IL
FIG. 1D
VISIBILITY IS HIGH (DECIPHERABILITY)
VISIBILITY IS LOW (DECIPHERABILITY)
FIG. 1E
VISIBILITY OF TRACE PATTERN
HIGH
LOW
LOW
HIGH
CONCENTRATION OF IMAGE AREA IL
FIG. 1F
VISIBILITY OF TRACE PATTERN
HIGH
LOW
THIN
THICK
THICKNESS OF PHOTORECEPTOR LAYER
FIG. 1G
SIZE OF IMAGE AREA IL
LARGE
SMALL
THIN
THICK
THICKNESS OF PHOTORECEPTOR LAYER

FIG. 6A Ta1

| PHOTORECEPTOR THICKNESS $\tau$ [$\mu$m] | NUMBER OF PIXELS |
|---|---|
| $40 \leq \tau$ | 6 |
| $35 \leq \tau < 40$ | 6 |
| $30 \leq \tau < 35$ | 4 |
| $25 \leq \tau < 30$ | 4 |
| $20 \leq \tau < 25$ | 2 |
| $\tau < 20$ | 2 |

FIG. 7 Ta2

| PHOTORECEPTOR THICKNESS $\tau$ [$\mu$m] | SELECT PATTERN |
|---|---|
| $40 \leq \tau$ | A |
| $35 \leq \tau < 40$ | A |
| $30 \leq \tau < 35$ | B |
| $25 \leq \tau < 30$ | B |
| $20 \leq \tau < 25$ | C |
| $\tau < 20$ | C |

FIG. 11 Ta3

| AVERAGE PRINTING RATE Pp [%] | COEFFICIENT β |
|---|---|
| Pp<1 | 0.5 |
| 1≤Pp<3 | 0.6 |
| 3≤Pp<5 | 0.7 |
| 5≤Pp<7 | 0.8 |
| 7≤Pp<9 | 0.9 |
| 9≤Pp<11 | 1.0 |
| 11≤Pp<13 | 1.1 |
| 13≤Pp | 1.2 |

FIG. 12

Ta4

| | CUMULATIVE PRINTED SHEET NUMBER Ns USING DEVELOPING DEVICE 6Y [k SHEET] | | | |
|---|---|---|---|---|
| CUMULATIVE ROTATION NUMBER Ro [k ROTATION] | Ns < 2 | 2 ≤ Ns < 30 | 30 ≤ Ns < 200 | 200 ≤ Ns |
| Ro < 100 | A | A | B | B |
| 100 ≤ Ro < 150 | A | B | B | B |
| 150 ≤ Ro < 200 | B | B | B | B |
| 200 ≤ Ro < 250 | B | B | B | B |
| 250 ≤ Ro < 300 | B | B | B | C |
| 300 ≤ Ro | C | C | C | C |

FIG. 13

Ta5

| CUMULATIVE ROTATION NUMBER Ro [k ROTATION] | ABSOLUTE HUMIDITY Ha [g/m³] | | |
|---|---|---|---|
| | Ha < 8 | 8 ≤ Ha < 11 | 11 ≤ Ha |
| Ro < 100 | A | A | B |
| 100 ≤ Ro < 150 | A | B | B |
| 150 ≤ Ro < 200 | B | B | B |
| 200 ≤ Ro < 250 | B | B | B |
| 250 ≤ Ro < 300 | B | B | B |
| 300 ≤ Ro | C | C | C |

FIG. 14

Ta6

| | COLOR INFORMATION ON BACKGROUND PORTION HAVING TRACE PATTERN FORMED THEREON | | |
|---|---|---|---|
| CUMULATIVE ROTATION NUMBER Ro [k ROTATION] | EQUAL TO OR MORE THAN 200 IN M GRADATION | OTHERS | SOLID WHITE |
| Ro < 100 | B | B | B |
| 100 ≤ Ro < 150 | B | B | B |
| 150 ≤ Ro < 200 | C | B | B |
| 200 ≤ Ro < 250 | C | B | B |
| 250 ≤ Ro < 300 | C | C | B |
| 300 ≤ Ro | C | C | B |

IMAGE FORMING APPARATUS

The entire disclosure of Japanese Patent Application No. 2016-030784 filed on Feb. 22, 2016 including description, claims, drawings, and abstract are incorporated herein by reference in its entirety.

BACKGROUND OF THE INVENTION

Field of the Invention

This disclosure relates to an image forming apparatus and, more particularly, relates to an image forming apparatus which combines an image signal with a trace pattern.

Description of the Related Art

In the types of an image forming apparatus, there is a type in which a specific trace pattern is combined with (superimposed on) a signal of an image to be printed for each image forming apparatus. When an image such as a banknote and a security for which copying is prohibited is formed by superimposing a trace pattern on an image signal, it is possible to identify (trace) an image forming apparatus which prints the image.

In relation to a technology for combining an image signal with a trace pattern, JP 2004-289873 A (JP 2004-289873 A) discloses a configuration in which the distinctiveness and the latency of a trace pattern are not reduced even when the concentration of a record image to be formed is changed. More specifically, JP 2004-289873 A discloses a configuration in which a lookup table used for gamma correction by a gamma correction circuit is selected in accordance with the deviation between the concentration of a measured toner patch and a target value and, aside from this, a trace pattern to be added to input image data is selected.

However, there is a problem in that the visibility of a trace pattern is changed according to the usage conditions of an image forming apparatus. In this regard, the technology disclosed in JP 2004-289873 A does not consider it at all. Thus, in the technology, there is a possibility that it is not possible to decode a trace pattern under the condition where, for example, the visibility of the trace pattern is reduced.

SUMMARY OF THE INVENTION

The present disclosure has been made to solve such problems described above, and an object of some aspects of the disclosure is to provide an image forming apparatus which can print a trace pattern having constant visibility regardless of the usage condition of the image forming apparatus.

To achieve the abovementioned object, according to an aspect, an image forming apparatus which forms an image on a medium on the basis of an input image signal, reflecting one aspect of the present invention comprises: an image carrier configured to carry a developed toner image transferred to the medium on a photoreceptor layer that is on the outer peripheral surface; a contact member arranged so as to be in contact with the surface of the photoreceptor layer; a trace pattern generating unit configured to generate a trace pattern indicating specific information on the image forming apparatus; a composition unit configured to add the trace pattern to the image signal; and an acquiring unit configured to acquire information on the thickness of the photoreceptor layer of the image carrier, wherein the trace pattern is used for arranging a plurality of image areas that are areas to which toner is adhered at respective positions corresponding to the specific information when the image corresponding to the trace pattern is formed on the medium, and the trace pattern generating unit is configured to generate the trace pattern with the image area whose size is reduced in accordance with reduction of the thickness of the photoreceptor layer.

The trace pattern generating unit preferably reduces the number of pixels constituting the image area, as the thickness of the photoreceptor layer is reduced.

The trace pattern generating unit preferably reduces the size of the pixel constituting the image area, as the thickness of the photoreceptor layer is reduced.

The image carrier is preferably configured so as to be rotatable. The information on the thickness of the photoreceptor layer preferably includes at least one of pieces of information on a cumulative rotation number of the image carrier, a cumulative rotation time, a cumulative moving distance, and a cumulative number of printed sheets on which an image is formed using the image carrier.

The information on the thickness of the photoreceptor layer preferably further includes a printing rate.

The image forming apparatus preferably further comprises a humidity sensor for measuring humidity. The trace pattern generating unit preferably performs control such that the size of the image area is reduced, as the humidity detected by the humidity sensor is increased.

The image forming apparatus preferably further comprises a developing device which includes a developer carrier that is rotatable and adheres toner to the photoreceptor layer. The trace pattern generating unit is preferably configured such that at least one of pieces of information on a cumulative rotation number of the developer carrier, a cumulative rotation time, a cumulative moving distance, and a cumulative number of printed sheets on which an image is formed using the developer carrier is acquired and the trace pattern of which the size of the image area is reduced, as the value of the piece of information is increased, is generated.

The image forming apparatus preferably further comprises an image processing unit configured to perform a predetermined process on the image signal. The composition unit preferably adds the trace pattern to the image signal subjected to the predetermined process.

The image forming apparatus preferably further comprises a storage unit for accommodating a plurality of trace patterns of which the sizes of the image areas differ from each other. The trace pattern generating unit preferably selects one trace pattern from the plurality of trace patterns accommodated in the storage unit according to information on the thickness of the photoreceptor layer.

The image forming apparatus preferably further comprises a storage unit for accommodating at least one or more threshold values in relation to the information on the thickness of the photoreceptor layer. The trace pattern generating unit is preferably configured such that the size of the image area is changed when the information on the layer thickness acquired by the acquiring unit is over or under the threshold value.

The image forming apparatus preferably further comprises a plurality of image forming units which respectively correspond to a plurality of colors for forming a color image. The composition unit preferably adds the trace pattern to an image signal of a specific color of image signals of the plurality of colors, being color-separated from the image signal.

The trace pattern generating unit preferably controls the size of the image area according to color information of an area of the image signal to which the trace pattern is added.

The contact member is preferably a charging roller for charging the image carrier.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIGS. 1A to 1G are views for describing an overview of a control of a trace pattern according to an embodiment;

FIGS. 6A and 6B are views illustrating the relationship between the thickness of a photoreceptor layer according to the embodiment and the number of pixels constituting an image area of the trace pattern;

FIG. 7 is a view for describing a table illustrating the relationship between the thickness of the photoreceptor layer according to the embodiment and the trace pattern;

FIG. 11 is a table illustrating the relationship between an average printing rate and a coefficient according to Modification Example 2;

FIG. 12 is a view for describing a table illustrating the relationship between a cumulative printed sheet number using a developing device, the cumulative rotation number of the photoreceptor, and the pattern of the image area according to Modification Example 3;

FIG. 13 is a view for describing a table illustrating the relationship between an absolute humidity of an image forming apparatus, the cumulative rotation number of the photoreceptor, and the pattern of the image area according to Modification Example 4;

FIG. 14 is a view for describing a table illustrating the relationship between color information on a background part on which a trace pattern is formed, the cumulative rotation number of the photoreceptor, and the pattern of the image area according to Modification Example 5.

DESCRIPTION OF THE PREFERRED EMBODIMENTS

Figure 2:
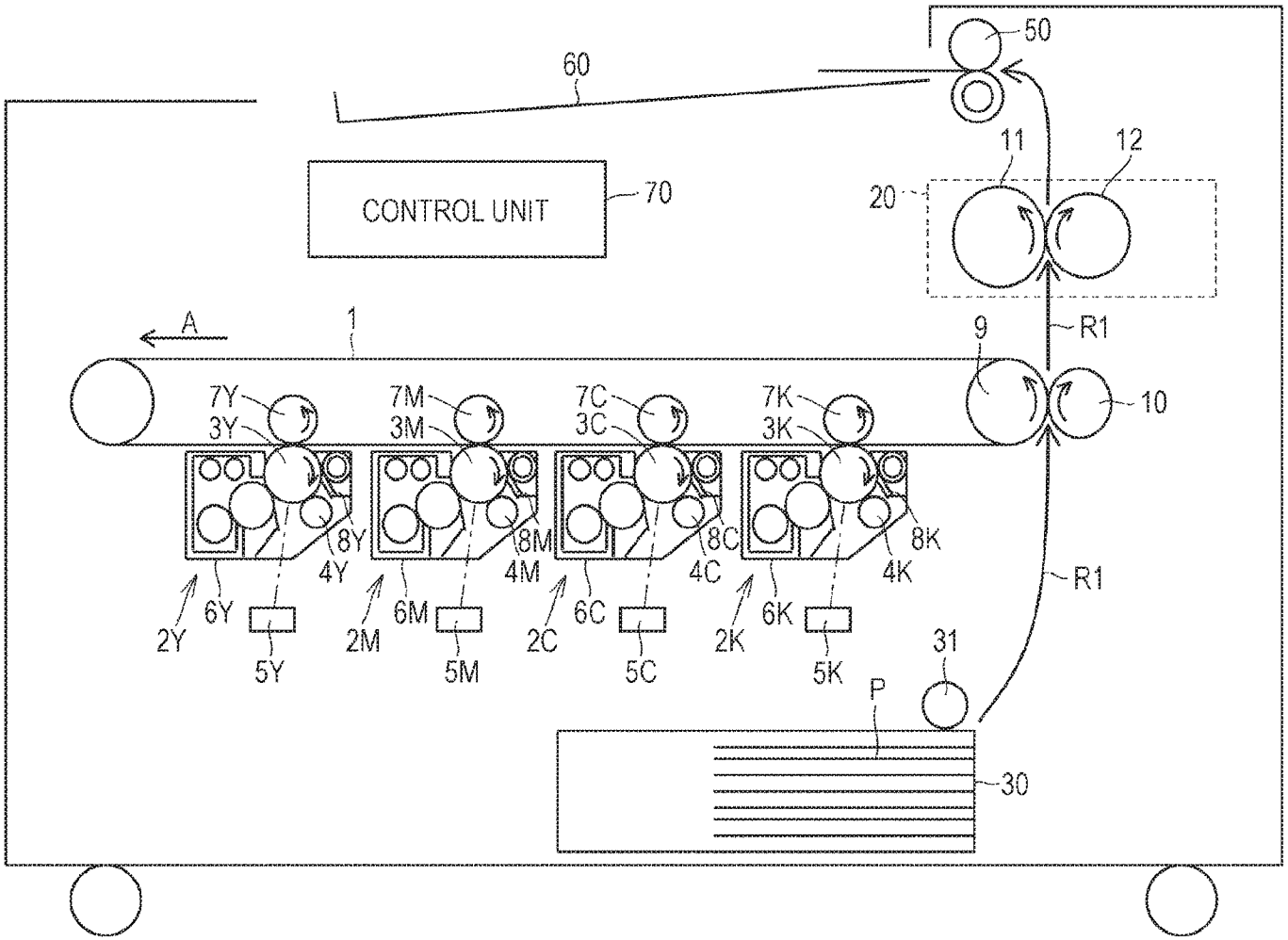
FIG. 2 is a view for describing a configuration example of an image forming apparatus according to the embodiment.

Hereinafter, an embodiment of the present invention will be described in detail with reference to the drawings. However, the scope of the invention is not limited to the illustrated examples. In a drawing, the same reference numerals and characters are given to the same or equivalent parts and the description thereof will not be repeated.

[A. Overview]

FIGS. 1A to 1G are views for describing the overview of the control of a trace pattern according to an embodiment. First, the trace pattern will be described with reference to FIG. 1A. Referring to FIG. 1A, the trace patterns are formed almost over the entirety of the surface of a paper sheet separately from image information to be printed. The reason for this is to prevent partial misuse of copy and form trace patterns on a duplicate even when an object such as a stamp which should not be copied and has an extremely small size is duplicated.

Next, when attention is paid to a pattern area PL in which one trace pattern is recorded, the trace pattern is constituted of a plurality of image areas IL. The arrangement of the plurality of image area IL in the pattern area PL is an arrangement pattern specified for each image forming apparatus. In other words, the trace pattern is to arrange a plurality of image areas IL which are the areas to which toner is adhered according to the arrangement pattern specified for the image forming apparatus when an image corresponding to the trace pattern is formed on a medium such as a paper sheet. The arrangement of the image areas IL in the pattern area PL is recognized by being scanned with a scanner, and thus it is possible to identify (trace) the image forming apparatus by which the paper sheet having a trace pattern superimposed thereon is printed.

Next, the properties of the visibility of the trace pattern will be described. As illustrated in FIGS. 1B and 1C, in relation to the trace pattern, the larger the size of the image area IL, the easier the information on the image forming apparatus for tracing is obtained (also referred to as "decipherability is high", hereinafter). In addition, as illustrated in FIGS. 1D and 1E, in relation to the trace pattern, the higher the concentration of the image area IL, the higher the decipherability. Furthermore, in relation to the trace pattern, the larger the size of the image area IL and the higher the concentration of the image area IL, the easier the pattern is also recognized by the human eye (also referred to as "the visibility is high"). When the trace pattern does not have the decipherability of more than certain amount, it is not possible to ensure the trace function. Therefore, when the size of the image area IL or the concentration is increased only to increase the trace function, the trace pattern is recognized as an image noise due to the visibility which is simultaneously increased with the increased size of the image area IL or concentration. Thus, even when the visibility (and the decipherability) of the trace pattern is extremely high or low, it becomes a problem. Therefore, it is preferable that the trace pattern printed on a medium such as a paper sheet always have a certain constant visibility in which both the trace function and the print quality can be achieved.

The applicant of this disclosure found that the visibility (and the decipherability) of the trace pattern is changed associated with the thickness of the photoreceptor layer in addition to the size of the image area IL constituting the trace pattern. This is because, for example, the reproducibility of dots reduced due to the reduction in the light diffusion in the photoreceptor layer when the thickness of the photoreceptor layer is reduced in accordance with use in contrast with the fact that the reproducibility (also referred to as a "reproducibility of dots", hereinafter) of output dots of a latent image exposed by a photoreceptor having a large initial thickness is reduced with respect to input dots due to thin spreading dots caused by the light rays diffused in the photoreceptor layer. Since the image area IL of the trace pattern is constituted of the small number of pixels (dots), the image area IL of the trace pattern is likely to be affected by, particularly, the change in the dot reproducibility due to the change in the thickness of the photoreceptor layer. Therefore, as illustrated in FIG. 1F, the larger the thickness of the photoreceptor layer, the lower the visibility of the trace pattern, and the smaller the thickness of the photoreceptor layer, the higher the visibility of the trace pattern. Many image forming apparatuses of an electrophotographic type of the recent years adopt a contact carting roller type and the reduction in unevenness caused by a charging roller and the extension of the lifespan thereof are achieved by refreshing the surface of the photoreceptor by scraping the photoreceptor layer. Therefore, the image forming apparatus of this type is likely to be affected by the change in the visibility and decipherability due to, particularly, the change in the thickness of the photoreceptor layer.

In the image forming apparatus according to the embodiment, the size of the image area IL constituting the trace pattern is reduced as the thickness of the photoreceptor layer is reduced in accordance with use, as illustrated in FIG. 1G. According to the configuration, the image forming apparatus according to the embodiment can print a trace pattern having a constant visibility regardless of the thickness of the photoreceptor layer relating to the usage conditions. Hereinafter, the configuration and control of the image forming apparatus will be described.

B. Embodiments b1. Image Forming Apparatus 100

FIG. 2 is a view for describing a configuration example of an image forming apparatus 100 according to the embodiment. The image forming apparatus 100 is an image forming apparatus of an electrophotographic type, such as a laser printer and an LED printer and forms an image on a medium such as a paper sheet on the basis of input image signal. As illustrated in FIG. 2, the image forming apparatus 100 includes an intermediate transfer belt 1 substantially in the center portion therein as a belt member. Four image forming units 2Y, 2M, 2C, and 2K corresponding to respective colors of yellow (Y), magenta (M), cyan (C), and black (K) are aligned along the intermediate transfer belt 1 below the lower horizontal portion of the intermediate transfer belt 1 and respectively have photoreceptors 3Y, 3M, 3C, and 3K. Each of the photoreceptors 3Y, 3M, 3C, and 3K develops a toner image transferred to a medium such as a paper sheet on the photoreceptor layer formed in the outer peripheral surface thereof.

In the peripheries of respective photoreceptors 3Y, 3M, 3C, and 3K as an image carrier, charging rollers 4Y, 4M, 4C, and 4K, print head portions 5Y, 5M, 5C, and 5K, developing devices 6Y, 6M, 6C, and 6K, primary transfer rollers 7Y, 7M, 7C, and 7K which respectively face the photoreceptors 3Y, 3M, 3C, and 3K with the intermediate transfer belt 1 interposed therebetween, and cleaning blades 8Y, 8M, 8C, and 8K are arranged in order in a rotation direction. Each image forming unit is configured to be exchangeable. In addition, each developing device has a developing roller, a screw which stirs and circulates two-component developing agents constituted of carriers and toner, and an accommodation portion for accommodating the developing agents. Those respective developing devices are configured to be exchangeable independently from the image forming units corresponding thereto.

A secondary transfer roller 10 is in press-contact with a part of the intermediate transfer belt 1, being supported by an intermediate transfer belt driving roller 9, and secondary transferring is performed in the area. A fixing heater unit 20 including a fixing roller 11 and a pressing roller 12 is arranged at a position on the downstream side of a transport path R1 behind the secondary transfer area.

A paper feeding cassette 30 is detachably disposed in the lower portion of the image forming apparatus 100. Paper sheet P which are loaded and stored in the paper feeding cassette 30 are send to the transport path R1 one by one from the uppermost paper sheet by the rotation of a paper feeding roller 31.

In the embodiment, the image forming apparatus 100 adopts, for example, an intermediate transfer system of a tandem type. However, the embodiment is not limited thereto. Specifically, the image forming apparatus may adopts a cycle system of an electrophotographic type or the image forming apparatus may adopts a direct transfer system where toner is directly transferred to a print medium from the developing device. In addition, the image forming apparatus may be a multifunction machine that combines functions of a copying machine, a printer, facsimile, and the like.

b2. General Operation of Image Forming Apparatus 100

Next, the general operation of the image forming apparatus 100 configured as described above will be described. When an image signal is input to a control unit 70 of the image forming apparatus 100 from an external device (a computer or the like, for example), digital image signals of yellow, magenta, cyan, and black, being color-converted from the image signals, are created in the control unit 70 and exposure is performed by emitting respective print head portions 5Y, 5M, 5C, and 5K of the respective image forming units 2Y, 2M, 2C, and 2K on the basis of the digital image signals.

Therefore, each of electrostatic latent images formed on the respective photoreceptors 3Y, 3M, 3C, and 3K is developed by the respective developing devices 6Y, 6M, 6C, and 6K and becomes a toner image of each color. The toner images of respective colors are superimposed on and primarily-transferred to the intermediate transfer belt 1, being moved in a direction of the arrow A in FIG. 2, in order by the operation of the respective primary transfer rollers 7Y, 7M, 7C, and 7K. After the primary transfer is performed, residual toner on the respective photoreceptors 3Y, 3M, 3C, and 3K are recovered by the respective cleaning blades 8Y, 8M, 8C, and 8K.

The toner image formed on the intermediate transfer belt 1 as described above is collectively secondary-transferred onto a paper sheet P by the operation of the secondary transfer roller 10.

The toner image secondary-transferred onto the paper sheet Preaches the fixing heater unit 20. The toner image is fixed to the paper sheet P by the operation of the heated fixing roller 11 and the pressing roller 12. The paper sheet P onto which the toner image is fixed is discharged to a paper discharge tray 60 via a paper discharge roller 50.

b3. Control Unit 70

Figure 3:
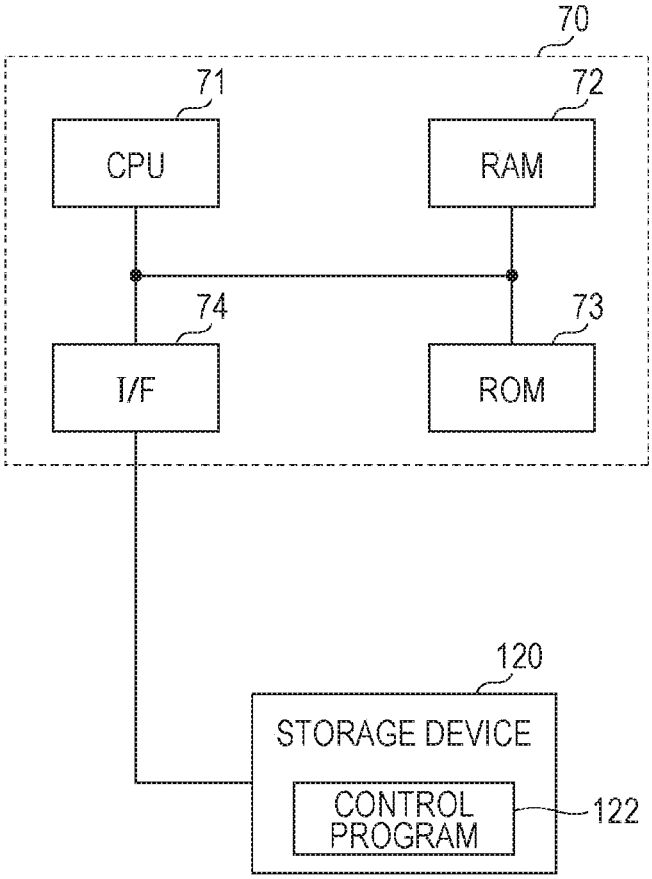
FIG. 3 is a view for describing a control unit according to the embodiment.

FIG. 3 is a view for describing the control unit 70 according to the embodiment. The control unit 70 includes a Central Processing Unit (CPU) 71, a Random Access Memory (RAM) 72, a Read Only Memory (ROM) 73, and an interface (I/F) 74 as a main control element.

The CPU 71 performs the entirety of the process of the image forming apparatus 100 by reading a control program 122 stored in a storage device 120 via the interface 74 and performing the program. The CPU 71 may be one of a Microprocessor, a Field Programmable Gate Array (FPGA), an Application Specific Integrated Circuit (ASIC), a Digital Signal Processor (DSP), and a circuit having other calculation functions. The control program 122 may not be provided as a single program and may be provided in a state where the control program is built in part of an arbitrary program. In this case, the control process according to the embodiment is performed in cooperation with the arbitrary program. Even in the case of the program which does not include some modules as described above, the program does not deviate from the purpose of the control program 122 according to the embodiment. In addition, some or all of the functions provided by the control program 122 may be performed by a dedicated hardware. Further, the image forming apparatus 100 may be configured in a form of a so-called cloud service where some of the process of the control program 122 is performed by at least one server.

Typically, the RAM 72 is a Dynamic Random Access Memory (DRAM) or the like and temporarily stores data necessary for the CPU 71 to operate the program or image data. Therefore, the RAM 72 functions as a so-called working memory.

Typically, the ROM 73 is a flash memory or the like and stores the program performed by the CPU 71 and various setting information associated with the operation of the image forming apparatus 100.

b4. Control of Trace Pattern

Figure 4:
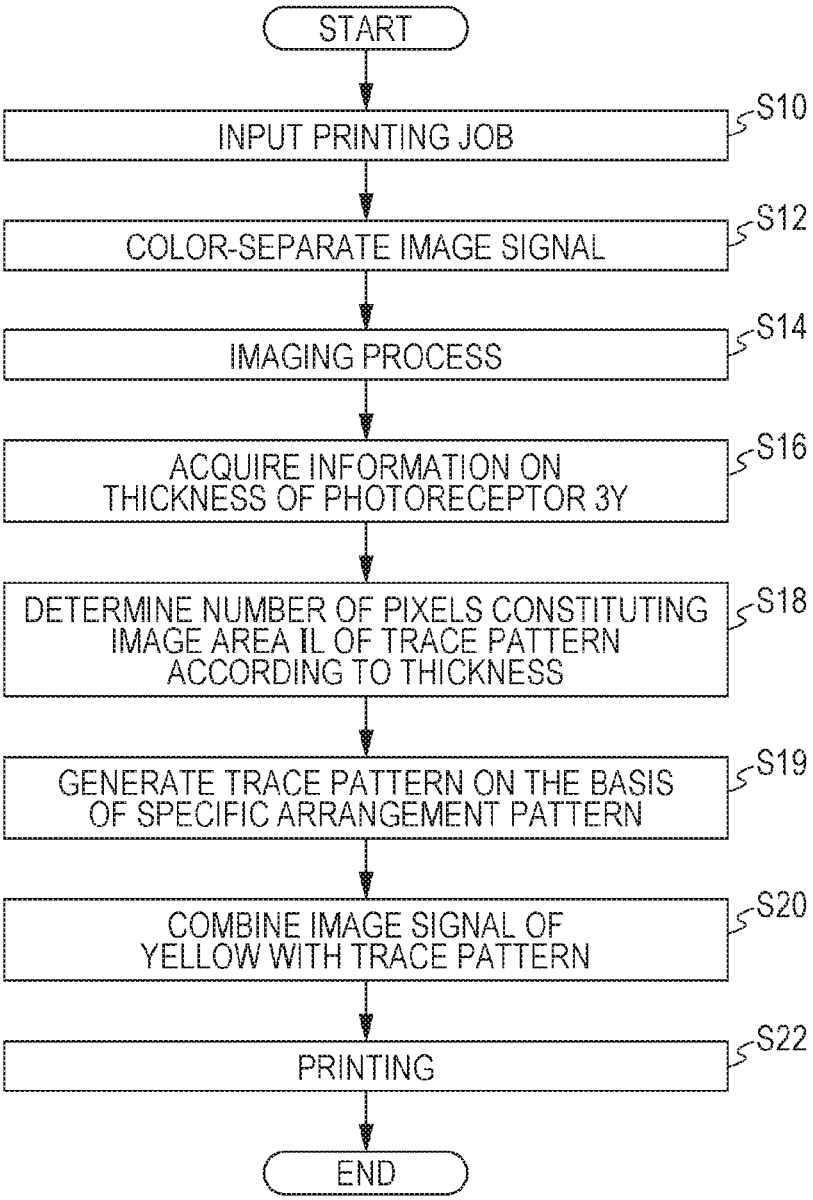
FIG. 4 is a flowchart for describing an image forming operation of the image forming apparatus according to the embodiment.

Next, a series of image forming operations of the image forming apparatus 100 including the control of the trace pattern will be described. FIG. 4 is a flowchart for describing the image forming operation of the image forming apparatus 100 according to the embodiment. The process illustrated in FIG. 4 is performed by performing a control program 122 stored in the storage device 120 by the control unit 70. In another aspect, some or all of the processes may be performed by a hardware other than a circuit element.

In step S10, the control unit 70 receives the input of a printing job with reference to FIG. 4. In step S12, the control unit 70 color-separates the input image signal into signals of yellow, magenta, cyan, and black corresponding to the color reproduction properties of the image forming apparatus 100. In step S14, the control unit 70 performs a so-called digital imaging process such as a correction process, a spatial filter process, a gradation reproduction process, and a misalignment correction process on each color-separated image signal. Therefore, the control unit 70 can perform adjustments according to the properties of the image forming apparatus 100 and environmental changes on the image signals to which the trace pattern is not combined.

Figure 5:
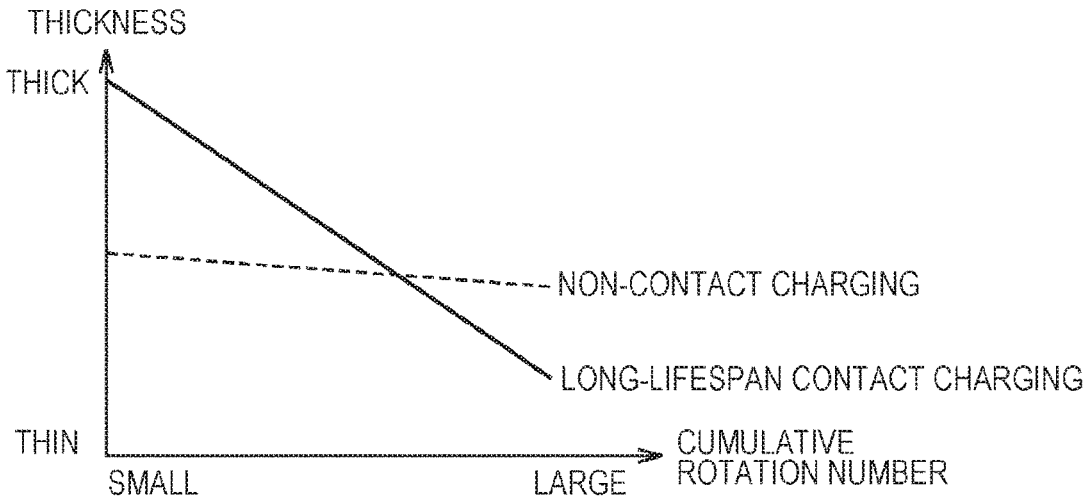
FIG. 5 is a view for describing the relationship between a cumulative rotation number and a thickness of a photoreceptor layer.

Next, in step S16, the control unit 70 acquires the information indicating the thickness of the photoreceptor 3Y. The reason for acquiring the thickness of the photoreceptor 3Y of yellow will be described below. It is difficult for human eyes to recognize a yellow image. Thus, the visibility of the trace pattern is suppressed and the decipherability can be secured by printing the trace pattern using toner of yellow. Hereinafter, the configuration for acquiring the information indicating the thickness of the photoreceptor 3Y will be described with reference to FIG. 5. FIG. 5 is a view for describing the relationship between a cumulative rotation number and a thickness of the photoreceptor layer.

The charging roller 4Y and the cleaning blade 8Y are in contact with the photoreceptor 3Y such that the charging roller 4Y and the cleaning blade 8Y are in contact with the surface of the photoreceptor. The thickness of the photoreceptor 3Y is affected by the contact with the charging roller 4Y and the cleaning blade 8Y and is gradually reduced with use (rotation). Particularly, when AC voltage is applied from the charging roller 4Y, the amount of reduction in thickness of the photoreceptor 3Y is increased for each rotation.

As illustrated in FIG. 5, it is possible to understand that the thickness of the photoreceptor 3Y adopting a contact charging type is sharply reduced as the cumulative rotation number of the photoreceptor 3Y is increased. On the contrary, it is possible to understand that the thickness of the photoreceptor 3Y adopting a non-contact charging type such as a corona discharger instead of the charging roller 4Y is gradually reduced since it is affected by only the cleaning blade 8Y.

The relationship between the thickness of the photoreceptor 3Y and the cumulative rotation number of the photoreceptor 3Y can be expressed by the following Equation (1).

[Equation 1]

$$\tau=\tau 0-\alpha\times Ro \tag{1}$$

$\tau$ indicates the thickness of the photoreceptor 3Y, $\tau$0 indicates the initial thickness of the photoreceptor 3Y, $\alpha$ indicates the predetermined coefficient, and Ro indicates the cumulative rotation number of the photoreceptor 3Y. The coefficient $\alpha$ is determined by the initial thickness $\tau$0 of the photoreceptor 3Y, a thickness $\tau$1 in the lifespan, and a rotation number Ro1 to the end of the lifespan. The coefficient $\alpha$ may be, for example, a value that is obtained by dividing the value obtained by subtracting the thickness $\tau$1 in the lifespan from the initial thickness $\tau$0 of the photoreceptor 3Y by the rotation number Ro1 to the end of the lifespan. The values of the initial thickness $\tau$0 of the photoreceptor 3Y, the thickness $\tau$1 in the lifespan, and the rotation number Ro1 to the end of the lifespan are the known values. Thus, the control unit 70 can calculate the thickness of the photoreceptor 3Y from the cumulative rotation number Ro of the photoreceptor 3Y. When the photoreceptor 3Y or the image forming unit 2Y including the photoreceptor 3Y is replaced, the cumulative rotation number Ro is reset to zero.

In another aspect, the control unit 70 may be configured such that, when the thickness of the photoreceptor 3Y is calculated, the cumulative rotation number of the photoreceptor 3Y is used. For example, the control unit 70 may be configured such that the thickness of the photoreceptor 3Y is calculated using at least one of pieces of information of a cumulative rotation (driving) time of the photoreceptor 3Y, a cumulative moving distance, and the cumulative number of printed sheets in which images are formed on media such as paper sheets using the photoreceptor 3Y.

Referring to FIG. 4 again, in step S18, the control unit 70 determines the size of the image area IL of the trace pattern in accordance with the calculated thickness of the photoreceptor 3Y. More specifically, the control unit 70 determines the number of pixels constituting the image area IL. Hereinafter, the control in step S18 will be described with reference to FIGS. 6A and 6B.

Figure 6B:
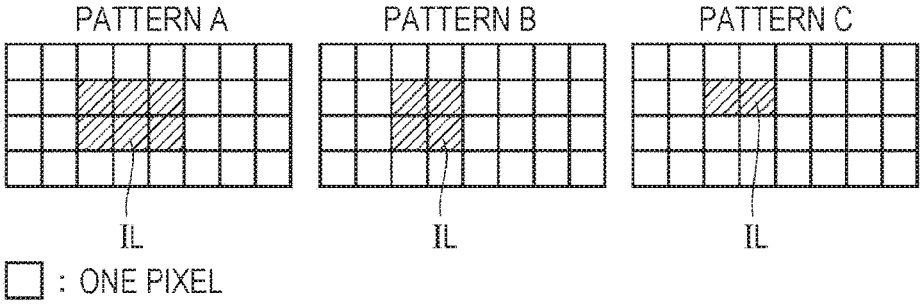

FIGS. 6A and 6B are views illustrating the relationship between the thickness of the photoreceptor 3Y according to the embodiment and the number of pixels constituting the image area IL of the trace pattern. In step S18, the control unit 70 determines the number of pixels constituting the image area IL corresponding to the calculated thickness of the photoreceptor 3Y with reference to the table Ta1 illustrated in FIG. 6A. The table Ta1 and the tables Ta2 described below to Ta6 are stored in the storage device 120.

As illustrated in FIGS. 1B and 1C, the visibility of the trace pattern is reduced, as the size of the image area IL is reduced, that is, the number of pixels constituting the image area IL being reduced. On the contrary, as illustrated in FIG. 1F, the visibility of the trace pattern is increased, as the thickness of the photoreceptor layer is reduced.

Therefore, the table Ta1 is configured such that the increase in the visibility of the trace pattern due to the reduction in the thickness of the photoreceptor 3Y is counteracted and the number of the pixels constituting the image area IL is reduced, as the thickness of the photoreceptor 3Y is reduced. The control unit 70 is configured such that, when the calculated thickness of the photoreceptor 3Y is over or under the threshold value in relation to the thickness of the photoreceptor layer stored in the table Ta1, the number of pixels constituting the image area IL is changed.

For example, when the calculated thickness of the photoreceptor 3Y is 32 μm, the control unit 70 determines the number of pixels constituting the image area IL to 4. In this case, the image area IL is configured so as to be illustrated in the pattern B of FIG. 6B, for example. In another aspect, when the calculated thickness of the photoreceptor 3Y is worn to 23 μm with use, the control unit 70 determines the number of pixels constituting the image area IL to 2. In this case, the image area IL is configured so as to be illustrated in the pattern C of FIG. 6B, for example.

Referring to FIG. 4 again, in step S19, the control unit 70 generates the trace pattern on the basis of the determined number of pixels constituting the image area IL and the arrangement pattern specified for the image forming apparatus 100 stored in the storage device 120. The arrangement pattern indicates the arrangement pattern of the image areas IL in the pattern area PL.

In step S20, the control unit 70 combines (superimposes) the image signal of yellow on which a predetermined imaging process is performed in step S14 with the trace pattern. In the image forming apparatus 100, the image signal is combined with the trace pattern independently from a predetermined imaging process such as a gamma correction process, as described above, in such a manner that the visibility of the trace pattern can be prevented from being changed by being affected by the predetermined imaging process. In step S22, the control unit 70 performs a printing process on the basis of the image signal of yellow combined with the trace pattern and the image signals of magenta, cyan, and black.

According to the description described above, the image forming apparatus 100 according to the embodiment can secure a constant visibility of the trace pattern regardless of the thickness of the photoreceptor layer, that is, the usage conditions of the photoreceptor. Therefore, the image forming apparatus 100 according to the embodiment can secure the visibility of the trace pattern where both the trace function and the printing quality are ensured.

In the example described above, the control unit 70 is configured so as to determine the number of pixels constituting the image area IL of the trace pattern in accordance with the calculated thickness of the photoreceptor 3Y (step S18). However, the configuration of the control unit 70 is not limited thereto. In another aspect, the control unit 70 may be configured such that one trace pattern is selected from a plurality of trace patterns of which the sizes (the numbers of pixels) of the image areas IL are differ from one another, the trace patterns being stored in the storage device 120, in accordance with the calculated thickness of the photoreceptor 3Y.

FIG. 7 is the table Ta2 illustrating the relationship between the thickness of the photoreceptor 3Y according to the embodiment and the trace pattern. The reference characters A, B, and C in the table Ta2 respectively indicate the pattern A, the pattern B, and the pattern C of the image areas IL illustrated in FIG. 6B. For example, when the thickness τ of the photoreceptor 3Y is 32 μm, the control unit 70 may set the pattern of the image areas IL constituting the trace pattern to the pattern B with reference to the table Ta2.

Figure 8:
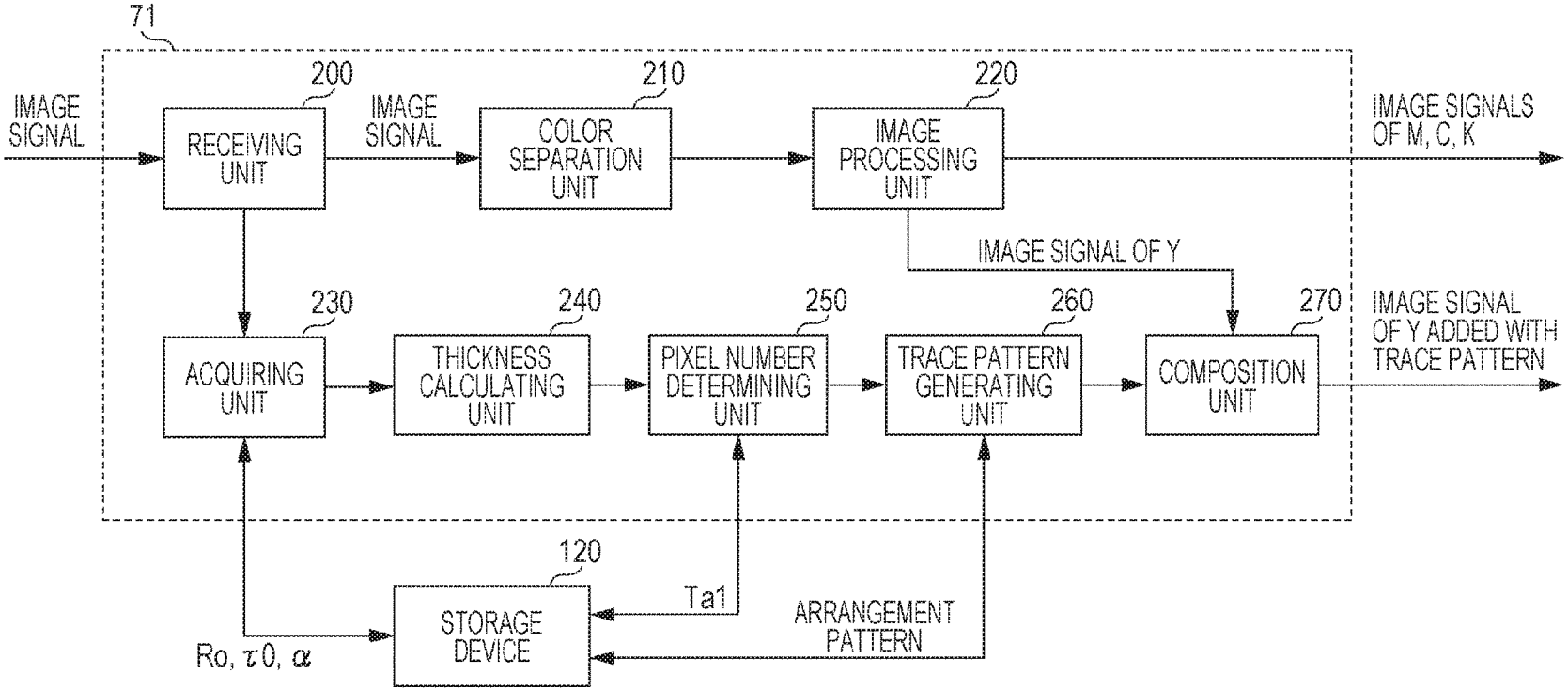
FIG. 8 is a function block diagram for describing a functional configuration of CPU according to the embodiment.

Next, from the viewpoint of the functional configuration of the CPU 71, the series of the control will be described with reference to FIG. 8. FIG. 8 is a functional block diagram for describing the functional configuration of the CPU 71 according to the embodiment. The CPU 71 has a receiving unit 200, a color separation unit 210, an image processing unit 220, an acquiring unit 230, a thickness calculating unit 240, a pixel number determining unit 250, a trace pattern generating unit 260, and a composition unit 270, as a main functional configuration.

Referring to FIG. 8, a printing job is input to the image forming apparatus 100 from a user and an image signal is input to the receiving unit 200. The receiving unit 200 receives the input of the image signal, outputs the image signal to the color separation unit 210, and outputs a control signal informing that the image signal has been input to the acquiring unit 230.

The color separation unit 210 color-separates the image signal input from the receiving unit 200 into respective colors of yellow, magenta, cyan, and black and outputs the color-separated image signals of respective colors to the image processing unit 220.

The image processing unit 220 performs predetermined imaging processes such as a gamma correction process, a spatial filter process, a gradation reproduction process, and a misalignment correction process on the color-separated image signals of the respective colors. In addition, the image processing unit 220 outputs the image signal of yellow subjected to the predetermined imaging processes to the composition unit 270 and outputs the other image signals of magenta, cyan, and black to the printed head portions 5M, 5C, and 5K.

The acquiring unit 230 receives the input of the control signal from the receiving unit 200, acquires the information on the cumulative rotation number Ro of the photoreceptor 3Y, the initial thickness τ0 of the photoreceptor 3Y, and the coefficient α stored in the storage device 120, and outputs the information to the thickness calculating unit 240. The thickness calculating unit 240 calculates the thickness of the photoreceptor 3Y according to the information input from the acquiring unit 230 and the above Equation (1) and outputs the calculation result to the pixel number determining unit 250.

The pixel number determining unit 250 compares the information on the thickness of the photoreceptor 3Y input from the thickness calculating unit 240 with the table Ta1 stored in the storage device 120, determines the number of pixels constituting the image area IL, and outputs the determined number of pixels to the trace pattern generating unit 260.

The trace pattern generating unit 260 generates a trace pattern on the basis of the arrangement pattern specified for the image forming apparatus 100, being stored in the storage device 120, and the number of pixels constituting the image area IL, being input from the pixel number determining unit 250, and outputs the trace pattern to the composition unit 270.

The composition unit 270 combines (superimposes) the image signal of yellow input from the image processing unit 220 with the trace pattern and outputs the combined image signal to the print head portion 5Y.

According to the description described above, the image forming apparatus 100 according to the embodiment can secure a constant visibility of the trace pattern regardless of the thickness of the photoreceptor layer, that is, the usage conditions of the photoreceptor.

b5. Modification Example 1—Change in the Size of Pixel

Figure 9:
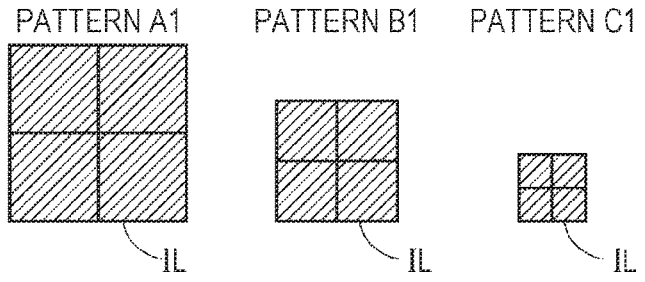
FIG. 9 is a view for describing an example of a pattern of an image area according to Modification Example.

In the example described above, the control unit 70 is configured so as to change the number of pixels constituting the image area IL of the trace pattern according to the thickness of the photoreceptor 3Y. However, the control unit 70 is not limited thereto. In other aspect, the control unit 70 may be configured such that the size for each pixel constituting the image area IL of the trace pattern is reduced, as the thickness of the photoreceptor 3Y is reduced. FIG. 9 is a view for describing an example of the pattern of the image areas IL according to Modification Example. For example, the control unit 70 may be configured such that the pattern is changed from the pattern A1 where the size of the pixel constituting the image area IL is the largest to the pattern B1 and the pattern Cl in order, as the thickness of the photoreceptor 3Y is reduced.

b6. Modification Example 2—Calculation of the Thickness Considering Printing Rate In the example described above, the control unit 70 is configured so as to use the information on the cumulative rotation number of the photoreceptor 3Y when the thickness of the photoreceptor 3Y is calculated. However, in another aspect, the control unit 70 may be configured so as to calculate the thickness also considering an average printing rate in addition to the information. Most toners used for an image forming apparatus according to the electrophotographic type are mixed with functional particles scraping a photoreceptor. When the printing rate is large, the size of the area where the photoreceptor and the toner are in contact with each other is increased. Therefore, when the printing rate is large, the amount of reduction in thickness of the photoreceptor layer is increased.

Figure 10:
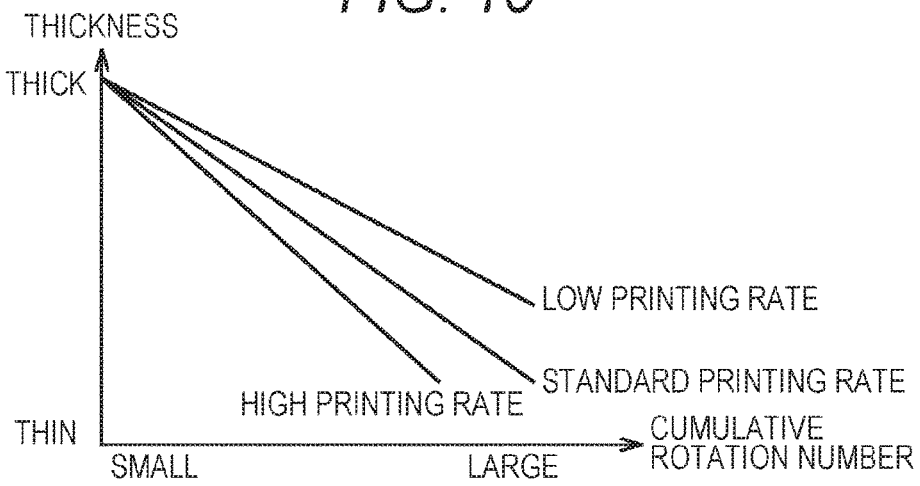
FIG. 10 is a view which illustrates the relationship between the cumulative rotation number of the photoreceptor and the thickness of the photoreceptor layer for each average printing rate.

FIG. 10 is a view which illustrates the relationship between the cumulative rotation number of the photoreceptor and the thickness of the photoreceptor layer for each average printing rate. As illustrated in FIG. 10, when the average printing rate is large with respect to a medium of the image forming apparatus 100, the amount of reduction in the thickness for each rotation of the photoreceptor is large and, when the printing rate is small, the amount of reduction in the thickness for each rotation of the photoreceptor is small.

Therefore, the control unit 70 of the image forming apparatus 100 according to Modification Example 2 calculates the thickness of the photoreceptor 3Y on the basis of the following Equation (2) instead of the above Equation (1) described above.

[Equation 2]

$$\tau=\tau 0-\alpha\times\beta\times Ro \quad (2)$$

A coefficient β is a coefficient in relation to an average printing rate Pp of yellow toner. The control unit 70 determines the value of the coefficient β on the basis of the table Ta3 illustrated in FIG. 11. FIG. 11 is a table illustrating the relationship between the average printing rate Pp and the coefficient β according to Modification Example 2. In consideration of properties illustrated in FIG. 10, the table Ta3 is configured such that, when the average printing rate Pp is large, the coefficient β is set to be large and, when the average printing rate Pp is small, the coefficient β is set to be small.

Furthermore, the control unit 70 of the image forming apparatus 100 calculates the printing rate of yellow toner from the color-separated image signal of yellow every time an image is printed and stores the calculated printing rate of yellow toner to the storage device 120. Therefore, the control unit 70 can calculate the average printing rate Pp of yellow toner.

According to the description described above, the image forming apparatus 100 according to Modification Example 2 calculates the thickness of the photoreceptor layer also considering the average printing rate in addition to the cumulative rotation number of the photoreceptor. Therefore, the image forming apparatus 100 according to Modification Example 2 can further accurately calculate the thickness of the photoreceptor. As a result, the image forming apparatus 100 according to Modification Example 2 can secure a constant visibility of the trace pattern regardless of the usage conditions of the photoreceptor. In the example described above, a case where the toner is mixed with functional particles scraping the photoreceptor is described. However, in another aspect, it is also possible to consider a case where functional particles are not included in the toner. In this case, the magnitude relationship of the coefficient β with respect to the average printing rate may be reversed compared to that of this Modification Example. In the aspect, the photoreceptor is worn by only a contact member such as a cleaning blade and a charging roller. Therefore, the smaller the printing rate is, the larger the size of the area where the photoreceptor and the contact member are in contact with each other is.

b7. Modification Example 3—Generation of Trace Pattern Considering Endurance of Developing Device In the example described above, the control unit 70 uses only the information on the thickness of the photoreceptor 3Y as a parameter affecting the visibility of the trace pattern. However, the control unit 70 is not limited thereto. The control unit 70 of the image forming apparatus 100 according to Modification Example 3 also considers, in addition to the information on the thickness of the photoreceptor 3Y, the information on the endurance of the developing device 6Y as a parameter affecting the visibility of the trace pattern. The information on the endurance of the developing device 6Y means a cumulative printed sheet number on which printing is performed using the developing device 6Y.

When the cumulative printed sheet number using the developing device 6Y is increased, the proportion of defective toner of which the state becomes the unintended charging state is increased in the developing device 6Y. This defective toner becomes fogging toner which adheres also to a part of the photoreceptor 3Y, not being exposed.

When the trace pattern is formed in a portion with fogging toner, it is easy for the shape of one pixel constituting the image area IL of the trace pattern to be maintained compared to a case where the trace pattern is formed in a portion without fogging toner. In other words, when the trace pattern is formed in a portion with fogging toner, the visibility of the trace pattern is high compared to a case where the trace pattern is formed in a portion without fogging toner.

Therefore, The control unit 70 according to Modification Example 3 performs control such that the size of the area (the number of pixels) constituting the image area IL of the trace pattern is reduced, as the cumulative printed sheet number using the developing device 6Y is increased.

For example, the control unit 70 may determines the number of pixels constituting the image area IL using the table Ta4 illustrated in FIG. 12 instead of the table Ta2 illustrated in FIG. 7. FIG. 12 is a view for describing the table Ta4 illustrating the relationship between the cumulative printed sheet number Ns using the developing device 6Y, the cumulative rotation number Ro of the photoreceptor 3Y, and the pattern of the image area IL according to Modification Example 3. The reference characters A, B, and C respectively indicate the pattern A, the pattern B, and the pattern C of the image areas IL illustrated in FIG. 6B.

As illustrated in FIG. 12, in the table Ta4, the number of pixels constituting the image area IL is reduced, as the cumulative rotation number Ro of the photoreceptor 3Y is increased and the number of pixels constituting the image area IL is reduced, as the cumulative printed sheet number Ns using the developing device 6Y is increased. For example, when the cumulative rotation number of the photoreceptor 3Y is one hundred twenty thousand and the cumulative printed sheet number using the developing device 6Y is fifty thousand, the control unit 70 sets the pattern of the image area IL to the pattern B (where the number of pixels constituting the image area IL is four). In addition, when the developing device 6Y or the image forming unit 2Y including the developing device 6Y is replaced, the cumulative printed sheet number Ns is reset to zero.

According to the description described above, the image forming apparatus 100 according to Modification Example 3 determines the size of the area constituting the image area IL of the trace pattern in consideration of the information on the endurance of the developing device in addition to the information on the thickness of the photoreceptor layer. Therefore, the image forming apparatus 100 according to Modification Example 3 can further secure a constant visibility of the trace pattern regardless of not only the usage conditions of the photoreceptor but also the usage conditions of the developing device.

Further, in another aspect, the control unit 70 may be configured such that the cumulative printed sheet number Ns using the developing device 6Y is used as the information on the endurance of the developing device 6Y. For example, the control unit 70 may be configured such that at least one of the pieces of the information on the cumulative rotation number of the developing roller included in the developing device 6Y, a cumulative rotation (driving) time, and a cumulative moving distance is used as the information on the endurance of the developing device 6Y. In this case, the control unit 70 is configured such that the size of the area (the number of pixels) constituting the image area IL is reduced, as the value indicating the information on the endurance of the developing device 6Y is increased.

b8. Modification Example 4—Generation of Trace Pattern Considering Humidity

In Modification Example 3, the control unit 70 is configured so as to consider, in addition to the information on the thickness of the photoreceptor 3Y, the information on the endurance of the developing device 6Y as the parameter affecting the visibility of the trace pattern. On the contrary, the control unit 70 according to Modification Example 4 generates a trace pattern in consideration of the absolute humidity of the image forming apparatus 100 in addition to the information on the thickness of the photoreceptor 3Y.

When an absolute humidity Ha of the image forming apparatus 100 is increased, the chargeability of toner in the developing device 6Y is reduced and the defective toner (the fogging toner) is increased. As the description as described above, when the amount of fogging toner is increased, the visibility of trace pattern is increased. In other words, when the absolute humidity Ha of the image forming apparatus 100 is increased, the visibility of trace pattern is increased.

Therefore, the control unit 70 according to Modification Example 4 performs control such that the size of the area (the number of pixels) constituting the image area IL of the trace pattern is reduced, as the absolute humidity Ha of the image forming apparatus 100 is increased. Furthermore, the image forming apparatus 100 according to Modification Example 4 has a temperature/humidity sensor (not illustrated). The control unit 70 according to Modification Example 4 calculates the absolute humidity of the image forming apparatus 100 on the basis of the detection result by the sensor.

For example, the control unit 70 may determine the number of pixels constituting the image area IL with the table Ta5 illustrated in FIG. 13. FIG. 13 is a view for describing the table Ta5 illustrating the relationship between the absolute humidity Ha of the image forming apparatus 100, the cumulative rotation number Ro of the photoreceptor 3Y, and the pattern of the image area IL according to Modification Example 4. The reference characters A, B, and C respectively indicate the pattern A, the pattern B, and the pattern C of the image area IL illustrated in FIG. 6B.

As illustrated in FIG. 13, the table Ta5 is configured such that the number of the pixels constituting the image area IL is reduced, as the cumulative rotation number Ro of the photoreceptor 3Y is increased, and the number of pixels constituting the image area IL is reduced, as the absolute humidity Ha of the image forming apparatus 100 is increased. For example, when the cumulative rotation number of the photoreceptor 3Y is one hundred twenty thousand and the absolute humidity Ha of the image forming apparatus 100 is 10 $g/m^3$, the control unit 70 sets the pattern of the image area IL to the pattern B (where the number of pixels constituting the image area IL is four).

According to the description described above, the image forming apparatus 100 according to Modification Example 4 determines the size of the area constituting the image area IL of the trace pattern in consideration of the absolute humidity of the image forming apparatus 100 in addition to the thickness of the photoreceptor layer. Therefore, the image forming apparatus 100 according to Modification Example 4 can further secure a constant visibility of the trace pattern regardless of changes in the external environment.

In another aspect, the image forming apparatus 100 according to Modification Example 4 may perform control such that the size of the area constituting the image area IL is reduced, as the relative humidity is increased rather than the absolute humidity.

b9. Modification Example 5—Generation of Trace Pattern Considering Color Information on Background Part As the description described above, the image forming apparatus 100 prints the trace pattern using yellow toner. Human eyes have the characteristic that, when a yellow image is printed on a white background, it is difficult to recognize the image. On the contrary, human eyes have the characteristic that, when a yellow image is printed on a magenta background, it is easy to recognize the image. Therefore, the visibility of the trace pattern is changed by color information on the background part on which the trace pattern is formed. Here, the image forming apparatus 100 according to Modification Example 5 generates a trace pattern in consideration of the information of the thickness of the photoreceptor 3Y and the color information of the background part on which the trace pattern is formed.

Hereinafter, the detail of the control will be described. First, the control unit 70 acquires the color information for each pattern area PL in which the trace pattern is formed on the basis of the image signal subjected to color separation and a predetermined imaging process. The color information is expressed by yellow (Y), magenta (M), cyan (C), and black (K) of 8 bits (256 gradations) respectively. For example, white is expressed by [Y,M,C,K]=[0,0,0,0] and black is expressed by [Y,M,C,K]=[0,0,0,255].

The control unit 70 determines the size of the area (the number of pixels) constituting the image area IL for each pattern area PL on the basis of acquired color information. For example, the control unit 70 may determine the number of pixels constituting the image area IL for each pattern area PL using the table Ta6 illustrated in FIG. 14. FIG. 14 is a view for describing the table Ta6 illustrating the relationship between the color information on the background part on which a trace pattern is formed, the cumulative rotation number Ro of the photoreceptor 3Y, and the pattern of the image area IL according to Modification Example 5. In addition, the reference characters B and C respectively indicate the pattern B and the pattern C of the image area IL illustrated in FIG. 6B.

As illustrated in FIG. 14, the table Ta6 is configured such that, when the gradation of magenta is equal to or more than 200 in the color information on the background part on which the trace pattern is formed, the trace pattern is set to a pattern where the number of pixels constituting the image area IL is small. Therefore, the image forming apparatus 100 according to Modification Example 5 can perform control to secure the high visibility of a trace pattern even when the trace pattern is formed in a background part where magenta is emphasized. On the contrary, the table Ta6 is configured such that, when the background part on which the trace pattern is formed is solid white, the trace pattern is set to a pattern where the number of pixels constituting the image area IL is large. Therefore, the image forming apparatus 100 according to Modification Example 5 can secure the high decipherability of a trace pattern when the trace pattern is formed on the background of solid white.

Figure 15:
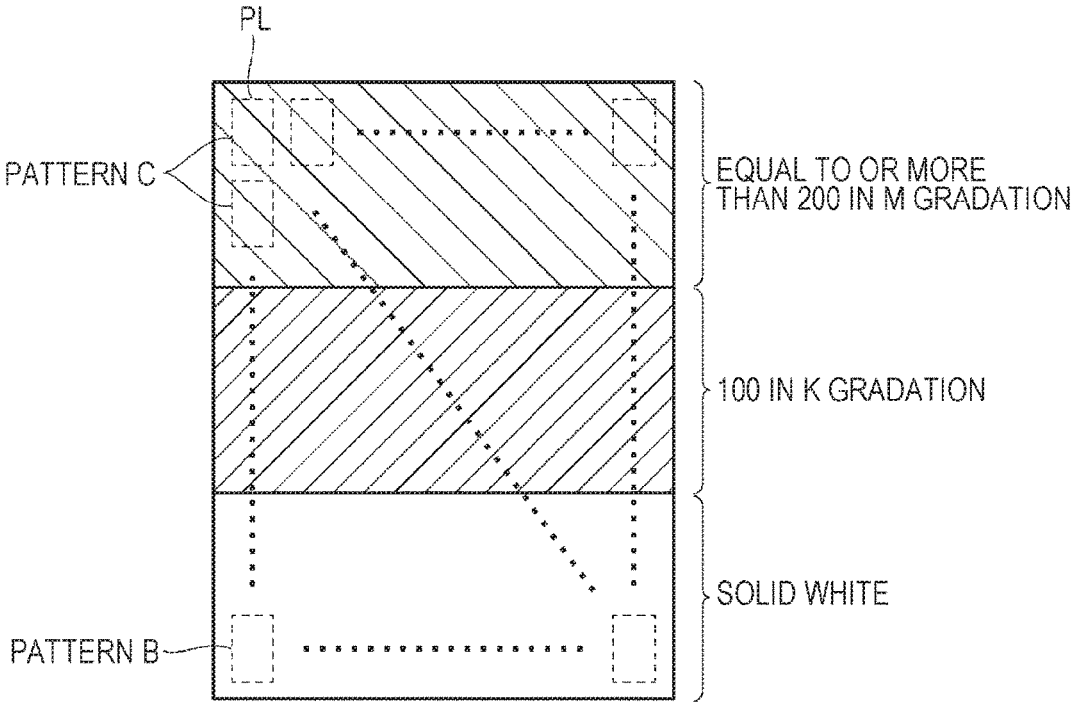
FIG. 15 is a view describing an image of which pieces of color information on the background part on which the trace pattern according to Modification Example 5 is formed differ from each other.

An example where the trace pattern is combined over the entirety of such an image illustrated in FIG. 15 and the cumulative rotation number Ro of the photoreceptor 3Y is one hundred seventy thousand will be described. In this case, the control unit 70 sets the pattern of the image area IL of the trace pattern, the image area IL being formed in an area of which the gradation of magenta is equal to or more than 200, to the pattern C (where the number of pixels constituting the image area IL is two) with reference to the table Ta6. In addition, the control unit 70 sets the pattern of the image area IL of the trace pattern, the image area IL being formed in an area of which the gradation of black is 100 and an area of solid white, to the pattern B.

According to the description described above, the image forming apparatus 100 according to Modification Example 5 determines the size of the area constituting the image area IL of the trace pattern in consideration of the color information on the background part on which the trace pattern is formed in addition to the thickness of the photoreceptor layer. Therefore, the image forming apparatus 100 according to Modification Example 5 can further secure a constant visibility of the trace pattern.

Although the present invention has been described and illustrated in detail, it is clearly understood that the same is by way of illustrated and example only and is not to be taken by way of limitation. In addition, an arbitrary combination can be adopted in the embodiment and Modification Examples 1 to 5 described above. The scope of the present invention is interpreted by terms of the appended claims and intended to include all modifications within the same meaning and range as those of equivalents of the appended claims.

What is claimed is:

1. An image forming apparatus which forms an image on a medium on the basis of an input image signal, comprising:

an image carrier configured to carry a developed toner image transferred to the medium on a photoreceptor layer that is on the outer peripheral surface;

a contact member arranged so as to be in contact with the surface of the photoreceptor layer;

a trace pattern generating unit configured to generate a trace pattern indicating specific information on the image forming apparatus;

a composition unit configured to add the trace pattern to the image signal; and an acquiring unit configured to acquire information on the thickness of the photoreceptor layer of the image carrier, wherein the trace pattern is used for arranging a plurality of image areas that are areas to which toner is adhered at respective positions corresponding to the specific information when the image corresponding to the trace pattern is formed on the medium, and the trace pattern generating unit is configured to generate the trace pattern with the image area whose size is reduced in accordance with reduction of the thickness of the photoreceptor layer.

2. The image forming apparatus according to claim 1, wherein the trace pattern generating unit reduces the number of pixels constituting the image area, as the thickness of the photoreceptor layer is reduced.

3. The image forming apparatus according to claim 1, wherein the trace pattern generating unit reduces the size of the pixel constituting the image area, as the thickness of the photoreceptor layer is reduced.

4. The image forming apparatus according to claim 1, wherein the image carrier is configured so as to be rotatable, and the information on the thickness of the photoreceptor layer includes at least one of pieces of information on a cumulative rotation number of the image carrier, a cumulative rotation time, a cumulative moving distance, and a cumulative number of printed sheets on which an image is formed using the image carrier.

5. The image forming apparatus according to claim 4, wherein the information on the thickness of the photoreceptor layer further includes a printing rate.

6. The image forming apparatus according to claim 1, further comprising:

a humidity sensor for measuring humidity, wherein the trace pattern generating unit performs control such that the size of the image area is reduced, as the humidity detected by the humidity sensor is increased.

7. The image forming apparatus according to claim 1, further comprising:

a developing device which includes a developer carrier that is rotatable and adheres toner to the photoreceptor layer, wherein the trace pattern generating unit is configured such that at least one of pieces of information on a cumulative rotation number of the developer carrier, a cumulative rotation time, a cumulative moving distance, and a cumulative number of printed sheets on which an image is formed using the developer carrier is acquired and the trace pattern of which the size of the image area is reduced, as the value of the piece of information is increased, is generated.

8. The image forming apparatus according to claim 1, further comprising:

an image processing unit configured to perform a predetermined process on the image signal, wherein the composition unit adds the trace pattern to the image signal subjected to the predetermined process.

9. The image forming apparatus according to claim 1, further comprising:

a storage unit for accommodating a plurality of trace patterns of which the sizes of the image areas differ from each other, wherein the trace pattern generating unit selects one trace pattern from the plurality of trace patterns accommodated in the storage unit according to information on the thickness of the photoreceptor layer.

10. The image forming apparatus according to claim 1, further comprising:

a storage unit for accommodating at least one or more threshold values in relation to the information on the thickness of the photoreceptor layer, wherein the trace pattern generating unit is configured such that the size of the image area is changed when the information on the layer thickness acquired by the acquiring unit is over or under the threshold value.

11. The image forming apparatus according to claim 1, further comprising:

a plurality of image forming units which respectively correspond to a plurality of colors for forming a color image, wherein the composition unit adds the trace pattern to an image signal of a specific color of image signals of the plurality of colors, being color-separated from the image signal.

12. The image forming apparatus according to claim 11, wherein the trace pattern generating unit controls the size of the image area according to color information of an area of the image signal to which the trace pattern is added.

13. The image forming apparatus according to claim 1, wherein the contact member is a charging roller for charging the image carrier.

* * * * *